US006240842B1

(12) United States Patent
Hailey

(10) Patent No.: US 6,240,842 B1
(45) Date of Patent: Jun. 5, 2001

(54) LIP STENCILING DEVICE

(76) Inventor: Brenda Hailey, P.O. Box 240, New Haven, CT (US) 06502

( * ) Notice: Subject to any disclaimer, the term of this patent is extended or adjusted under 35 U.S.C. 154(b) by 0 days.

(21) Appl. No.: 09/522,504

(22) Filed: Mar. 10, 2000

(51) Int. Cl.[7] ..... A45D 40/30; B05C 17/06

(52) U.S. Cl. ..... 101/127; 101/114; 132/319; 33/562

(58) Field of Search ..... 101/35, 41, 114, 101/127, 129; 132/319, 320; 2/452; 33/562, 563, 564, 565

(56) References Cited

U.S. PATENT DOCUMENTS 1,556,744 * 10/1925 Ansehl ..... 132/320
2,199,720 * 5/1940 Catelin ..... 132/319
2,248,533 * 7/1941 Gibert ..... 132/319
4,886,079 * 12/1989 Mooney ..... 132/319
5,186,190 * 2/1993 Hirzel ..... 132/319
5,642,178 * 6/1997 Leonardi et al. ..... 2/452
5,836,998 * 11/1998 Mueller et al. ..... 101/35

* cited by examiner

*Primary Examiner*—John S. Hilten
*Assistant Examiner*—Leslie J. Grohusky

(57) ABSTRACT

A lip stencil plate for placing stencils on a user's lips. The lip stencil plate includes a stencil panel for placing against a user's face. The stencil panel has an inner surface and an outer surface. The outer surface is convex and the inner surface is concave for placement against the face of a user. A plurality of bores through the panel are used for stenciling.

5 Claims, 2 Drawing Sheets

LIP STENCILING DEVICE

BACKGROUND OF THE INVENTION

1. Field of the Invention

The present invention relates to stenciling devices and more particularly pertains to a new lip stencil plate for placing stencils on a user's lips.

2. Description of the Prior Art

The use of stenciling devices is known in the prior art. More specifically, stenciling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,309,825; U.S. Pat. No. 4,209,565; U.S. Pat. No. 3,929,068; U.S. Pat. No. Des. No. 301,186; U.S. Pat. No. 3,465,445; and U.S. Pat. No. 3,280,732.

While these devices fulfill their respective, particular objectives and requirements, the aforementioned patents do not disclose a new lip stencil plate. The inventive device includes a stencil panel for placing against a user's face. The stencil panel has an inner surface and an outer surface. The outer surface is convex and the inner surface is concave for placement against the face of a user. A plurality of bores through the panel are used for stenciling.

In these respects, the lip stencil plate according to the present invention substantially departs from the conventional concepts and designs of the prior art, and in so doing provides an apparatus primarily developed for the purpose of placing stencils on a user's lips.

SUMMARY OF THE INVENTION

In view of the foregoing disadvantages inherent in the known types of stenciling devices now present in the prior art, the present invention provides a new lip stencil plate construction wherein the same can be utilized for placing stencils on a user's lips.

The general purpose of the present invention, which will be described subsequently in greater detail, is to provide a new lip stencil plate apparatus and method which has many of the advantages of the stenciling devices mentioned heretofore and many novel features that result in a new lip stencil plate which is not anticipated, rendered obvious, suggested, or even implied by any of the prior art stenciling devices, either alone or in any combination thereof.

To attain this, the present invention generally comprises a stencil panel for placing against a user's face. The stencil panel has an inner surface and an outer surface. The outer surface is convex and the inner surface is concave for placement against the face of a user. A plurality of bores through the panel are used for stenciling.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lip stencil plate apparatus and method which has many of the advantages of the stenciling devices mentioned heretofore and many novel features that result in a new lip stencil plate which is not anticipated, rendered obvious, suggested, or even implied by any of the prior art stenciling devices, either alone or in any combination thereof.

It is another object of the present invention to provide a new lip stencil plate which may be easily and efficiently manufactured and marketed.

It is a further object of the present invention to provide a new lip stencil plate which is of a durable and reliable construction.

An even further object of the present invention is to provide a new lip stencil plate which is susceptible of a low cost of manufacture with regard to both materials and labor, and which accordingly is then susceptible of low prices of sale to the consuming public, thereby making such lip stencil plate economically available to the buying public.

Still yet another object of the present invention is to provide a new lip stencil plate which provides in the apparatuses and methods of the prior art some of the advantages thereof, while simultaneously overcoming some of the disadvantages normally associated therewith.

Still another object of the present invention is to provide a new lip stencil plate for placing stencils on a user's lips.

Yet another object of the present invention is to provide a new lip stencil plate which includes a stencil panel for placing against a user's face. The stencil panel has an inner surface and an outer surface. The outer surface is convex and the inner surface is concave for placement against the face of a user. A plurality of bores through the panel are used for stenciling.

Still yet another object of the present invention is to provide a new lip stencil plate that alternate stencils which can be attached to a strap.

Even still another object of the present invention is to provide a new lip stencil plate that allows various shapes to be stenciled on a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
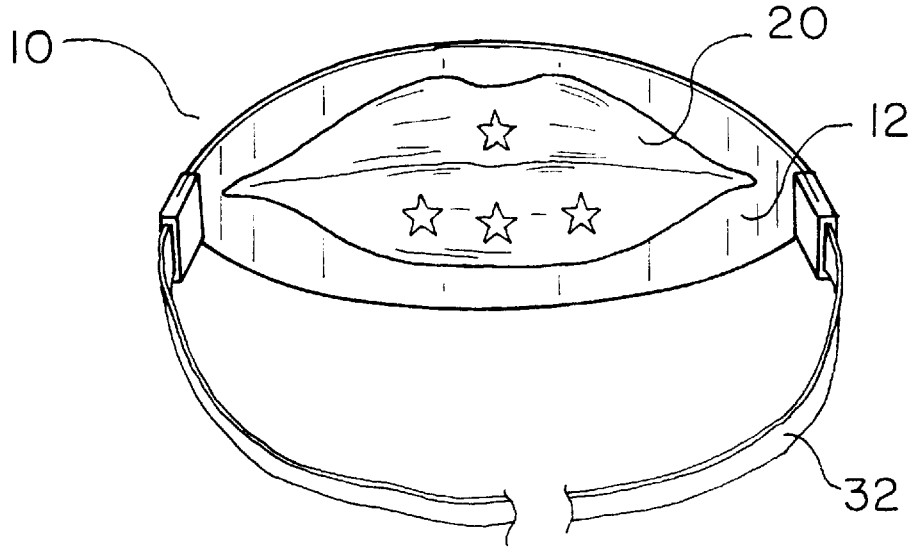
FIG. 1 is a schematic perspective view of a new lip stencil plate according to the present invention.
Figure 2:
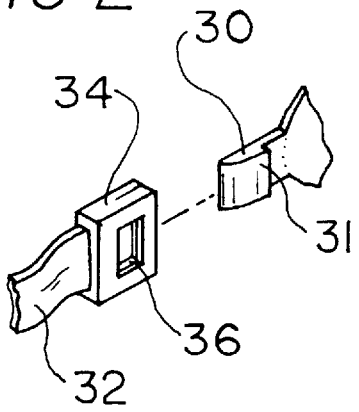
FIG. 2 is a schematic perspective view of the clasp of the present invention.
Figure 3:
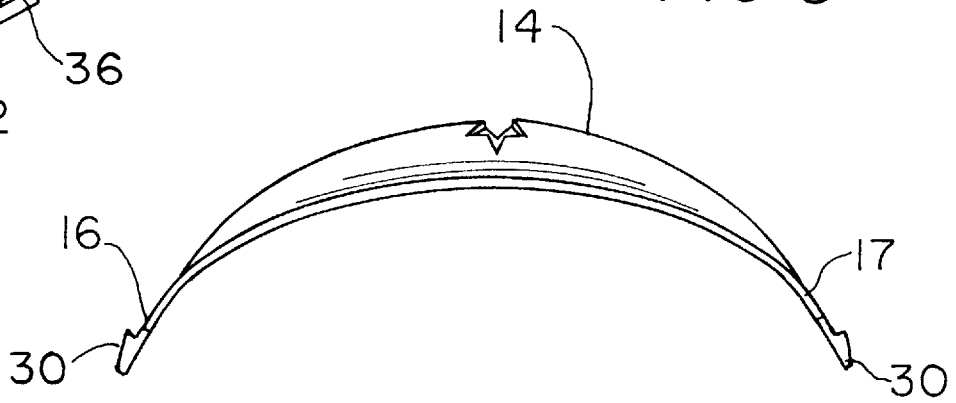
FIG. 3 is a schematic top view of the present invention.
Figure 4:
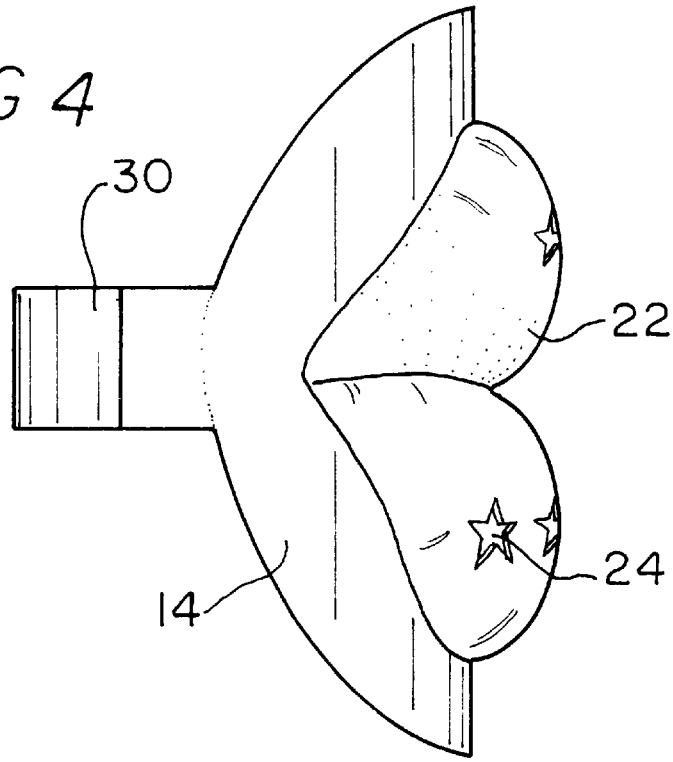
FIG. 4 is a schematic side view of the present invention.
Figure 5:
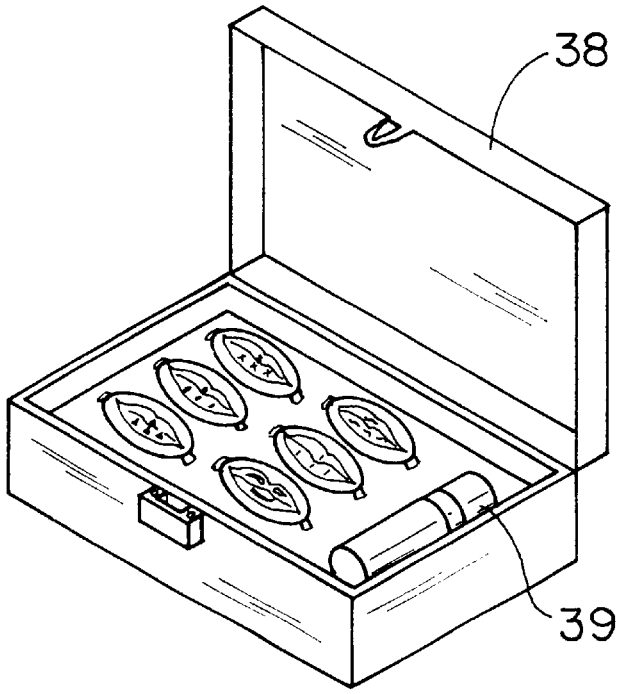
FIG. 5 is a schematic perspective view of the present invention.

With reference now to the drawings, and in particular to FIGS. 1 through 5 thereof, a new lip stencil plate embodying the principles and concepts of the present invention and generally designated by the reference numeral 10 will be described.

As best illustrated in FIGS. 1 through 5, the lip stencil plate 10 generally comprises a stencil panel for placing against a user's face. The stencil panel has an inner surface 12 and an outer surface 14 defining a periphery therebetween. The stencil panel has a first end 16 and a second end 17. The outer surface 14 is convex and the inner surface 12 is concave for placement against the face of a user. The stencil panel has a depression therein 20, wherein the depression is in the inner surface 12. The depression extends toward the outer wall 14 such that the outer wall is extended outward and forms a ridge 22 on the outer surface of the panel. The ridge 22 has a shape generally corresponding to the shape of human lips such that the lips of the user may be positioned in the depression.

A plurality of bores 24 are located in the panel for stenciling. The bores are located in the depression 20 for alignment with a user's lips which would be positioned in the depression. Preferably, the bores 24 each have a shape selected from the group containing circles, stars, squares, half-moons, letters and triangles, however, any of the infinite shapes may be used and could include objects and animals.

A pair of attachment members 30 attach the stencil panel to a strap 32. Each of the attachment members is fixedly coupled to one of the first 16 and second ends 17 of the stencil panel. The attachment members each extend away from the depression and each has a shoulder 31.

A pair of clasps 34 clasp the strap to the attachment members. The clasps are a generally rectangular housings, wherein each having a well 36 therein adapted for receiving the shoulder portion of each of the elongate members.

A strap 32 holds the stencil panel to the head of the user. The strap has a first end and a second end, not illustrated. The first end and the second end each are fixedly coupled to each of the clasps 34.

Also included is a container 38 which could hold a plurality of panels and a stencil marker 39.

In use, a panel is selected, placed over the lips and the bores are colored in with a stencil marker. Preferably, the panels have attachment members which are placed in the well of a clasp. The clasp is connected to a band which is placed over the head and which will hold the stencil securely against the user's lips.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stenciling device for marking precisely shaped figures on a users lips, comprising:

a stencil panel for placing against a user's face, said stencil panel having an inner surface and an outer surface, said outer surface being convex and said inner surface being concave for placement against the face of a user;

a plurality of bores through said panel for stenciling; and a depression in said stencil panel, wherein said depression is in said inner surface, said depression extending toward an outer surface such that said outer wall extends outward to form a ridge on said outer surface, said ridge having a shape generally corresponding to the shape of human lips such that lips of a user may be positioned in said depression, a periphery extending around said depression for defining an outline of lips of a user, wherein said bores are located in said depression and within said periphery for alignment with a user's lips positioned in said depression such that said bores permit marking through said panel and onto the lips of a user.

2. The stenciling device for marking precisely shaped figures on a users lips as in claim 1, wherein said bores each have a shape selected from the group consisting of stars, squares, half-moons, letters and triangles.

3. The stenciling device for marking precisely shaped figures on a users lips as in claim 1, further comprising:

a strap for holding said stencil panel to a head of a user;

a pair of attachment members for attaching said stencil panel to said strap, each of said attachment members being fixedly coupled to one of a first and second ends of said stencil panel, each of said attachment members having a shoulder thereon;

a pair of clasps for clasping said strap to said attachment members, each of said clasps being a generally rectangular housing, wherein each of said clasps have a well therein adapted for receiving said shoulder of each of said attachment members;

wherein said strap has a first end and a second end, said first end and said second end of said strap each being fixedly coupled to each of said clasps.

4. A stenciling device for marking precisely shaped figures on a users lips, comprising:

a stencil panel for placing against a user's face, said stencil panel having an inner surface and an outer surface defining a periphery therebetween, said stencil panel having a first end and a second end, said outer surface being convex and said inner surface being concave for placement against the face of a user, said stencil panel having a depression therein, wherein said depression is in said inner surface, said depression extending toward said outer surface such that an outer wall is extended outward and forming a ridge on said outer surface, said ridge having a shape generally corresponding to the shape of human lips such that lips of a user may be positioned in said depression, a periphery extending around said depression such that said periphery is adapted for defining an outline of lips of a user;

a plurality of bores through said panel for stenciling, said bores being located in said depression and within said periphery for alignment with a user's lips positioned in said depression such that said bores permit stenciling onto the lips of a user, said bores each having a shape selected from the group consisting of stars, squares, half-moons, letters and triangles;

a strap for holding the stencil panel to said head of a user;

a pair of attachment members for attaching said stencil panel to said strap, each of said attachment members being fixedly coupled to one of said first and second ends of said stencil panel, said attachment members each extending away from said depression, each of said attachment members having a shoulder thereon;

a pair of clasps for clasping said strap to said attachment members, each of said clasps being a generally rectangular housing, wherein each of said clasps have a well therein adapted for receiving said shoulder portion of each of said attachment members; and said strap having a first end and a second end, said first end and said second end of said strap each being fixedly coupled to each of said clasps.

5. A stenciling system for marking precisely shaped figures on a users lips, comprising:

a plurality of stencil panels each for placing against a user's face, each of said stencil panels having an inner surface and an outer surface, said outer surface being convex and said inner surface being concave for placement against the face of a user;

a plurality of bores through each of said panels for stenciling;

a depression in each of said stencil panels, wherein said depression is in said inner surface, said depression extending toward said outer surface such that an outer wall extends outward to form a ridge on said outer surface, said ridge having a shape generally corresponding to the shape of human lips such that lips of a user may be positioned in said depression, a periphery extending around said depression for defining an outline of lips of a user, wherein said bores are located in said depression and within said periphery for alignment with a user's lips positioned in said depression such that said bores permit marking through each of said panels and onto the lips of a user;

each of said bores of a first of said panels having a star shape;

each of said bores of a second of said panels having a square shape;

each of said bores of a third of said panels having a half-moon shape;

each of said bores of a fourth of said panels having a triangle shape;

each of said bores of a fifth of said panels having a shape of a letter;

a container for storing each of said panels and a marker, said marker for marking through said bores of each of said panels onto the lips of the user.

* * * * *